US009318277B2

(12) United States Patent
Malacara-Carrillo et al.

(10) Patent No.: US 9,318,277 B2
(45) Date of Patent: Apr. 19, 2016

(54) ELECTRICAL CONTACT APPARATUS, ASSEMBLIES, AND METHODS

(71) Applicant: Siemens Industry, Inc., Alpharetta, GA (US)

(72) Inventors: Hector Manuel Malacara-Carrillo, Norcross, GA (US); Thomas William Holland, Flowery Branch, GA (US); Oscar Rodrigo Ollervides Madrigal, Norcross, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 256 days.

(21) Appl. No.: 14/034,674

(22) Filed: Sep. 24, 2013

(65) Prior Publication Data

US 2015/0083558 A1 Mar. 26, 2015

(51) Int. Cl.

| | |
|---|---|
| ***H01H 1/06*** | (2006.01) |
| ***H01H 1/023*** | (2006.01) |
| ***H01H 1/027*** | (2006.01) |
| ***H01H 11/04*** | (2006.01) |
| *H01H 11/06* | (2006.01) |

(52) U.S. Cl.

CPC ..... *H01H 1/023* (2013.01); *H01H 1/027* (2013.01); *H01H 1/06* (2013.01); *H01H 11/048* (2013.01); *H01H 11/06* (2013.01); *Y10T 29/49206* (2015.01); *Y10T 29/49208* (2015.01)

(58) Field of Classification Search

CPC ..... H01H 1/023; H01H 1/04; H01H 1/06; H01H 1/027; H01H 11/048

USPC ..... 200/266, 262, 263, 265, 267, 268, 279; 218/130–133

See application file for complete search history.

(56) References Cited

U.S. PATENT DOCUMENTS

| | | | | |
|---|---|---|---|---|
| 2,641,670 | A * | 6/1953 | Graves, Jr. | H01H 1/0233 200/264 |
| 4,803,322 | A | 2/1989 | Shibata | |
| 5,420,384 | A * | 5/1995 | Okutomi | H01H 1/0203 200/266 |
| 8,049,126 | B2 * | 11/2011 | Chen | H01H 1/5866 200/244 |
| 2011/0198203 | A1 * | 8/2011 | Mueller | H01H 9/38 200/238 |

* cited by examiner

*Primary Examiner* — Amy Cohen Johnson
*Assistant Examiner* — Marina Fishman

(57) ABSTRACT

An electrical contact is disclosed. The electrical contact includes a first element of a first material having one or more aperture, and a second element of a second material, the second element being positioned in at least one aperture of the one or more aperture of the first element, wherein the second material is different from the first material. Electrical contact devices, assemblies, and methods are provided, as are other aspects.

20 Claims, 9 Drawing Sheets

ELECTRICAL CONTACT APPARATUS, ASSEMBLIES, AND METHODS

FIELD

The present invention relates generally to electrical contacts, and more particularly to electrical contacts for electrical interconnection devices such as circuit breakers, contactors, or switches.

BACKGROUND

Electrical interconnection devices such as circuit breakers are used in certain electrical systems for protecting an electrical circuit coupled to an electrical power supply. Its basic function is to detect a fault condition and, by interrupting continuity, to immediately discontinue electrical flow.

Circuit breakers may be conventional mechanical-type circuit breakers or electronic circuit breakers. One type of electronic circuit breaker is a ground fault circuit interrupter (GFCI). GFCIs are utilized in electrical systems to prevent electrical shock hazards, and are typically included in electrical circuits adjacent to water, such as in residential bathrooms or kitchens. Another type of electrical circuit breaker is an arc fault circuit interrupter (AFCI). AFCIs interrupt power to an electrical circuit when an arcing situation is detected within the circuit. Conventional mechanical and electronic circuit breakers (e.g., GFCIs and AFCIs) include tripping mechanisms that may include electrical contacts.

The electrical contacts generally carry the load current without excessive heating, and also withstand the heat of any arc produced when interrupting (opening) the connected circuit or branch. Service life of the contacts can be limited by the erosion of contact material due to arcing while interrupting the current. Further, during a current overload condition, arcing may occur which may result in degradation of contact welding or other degradation.

Accordingly, there is a long-felt and unmet need for electrical contacts having improved performance.

SUMMARY

According to first embodiment, an electrical contact apparatus is provided. The electrical contact apparatus includes a first element of a first material having one or more apertures, and a second element of a second material positioned within at least one aperture of the one or more aperture, wherein the second material is different from the first material.

In an assembly embodiment, a circuit interconnect device is provided. The circuit interconnect device including a first element of a first material, the first element having one or more aperture, and a second element of a second material, the second element positioned in at least one aperture of the one or more aperture, wherein the second material is different from the first material, and the first element and the second element are attached onto a metallic support or a conductor.

In a method embodiment, a method for preparation of an electrical contact is provided. The method includes providing a first element, of a first material having a composition of silver having a range of about 40% to about 60%, the first element having one or more aperture, providing a second element of a second material having a composition of silver having a range of about 70% or more; inserting the second element into at least one aperture of the one or more aperture of the first element; and attaching the first element and the second element to at least one conductor.

Still other aspects, features, and advantages of embodiments of the present invention may be readily apparent from the following detailed description by illustrating a number of example embodiments and implementations. The present disclosed subject matter may also be capable of other and different embodiments, and its several details may be modified in various respects, all without departing from the scope of the present disclosed subject matter. Accordingly, the drawings and descriptions are to be regarded as illustrative in nature, and not as restrictive. The drawings are not necessarily drawn to scale. Like numerals are used throughout to denote like elements. The disclosed subject matter is to cover all modifications, equivalents, and alternatives falling within the scope of the disclosed subject matter.

DETAILED DESCRIPTION

Figure 1:
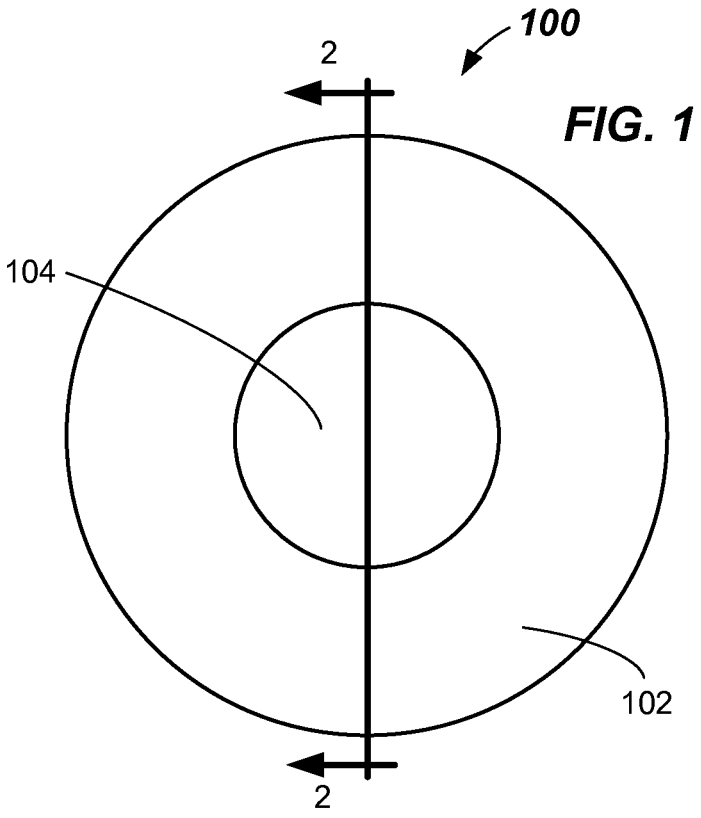
FIG. 1 illustrates a front plan view of the electrical contact device, according to embodiments.

The present invention relates to the field of electrical contacts. It relates more specifically to devices, methods, and assemblies related to electrical contacts including contact materials and its manufacturing process.

In some embodiments, the electrical contact can be incorporated into a group consisting of at least one type of circuit interconnect device, at least one type of circuit breaker, at least one type of switch or at least one type of other non-circuit breaker devices. The electrical contacts may be referred to as contacts, contact assemblies, and the like.

For example, electrical contacts may be adapted for the production of low voltage electrical contacts, such as electrical contacts whose normal operating range lies approximately between about 10 volts and about 1000 volts and between about 1 ampere and about 5,000 amperes. Such electrical contacts are generally used in the domestic and industrial industries, for circuit interconnection devices such as switches, relays, contactors, circuit breakers and other interconnection devices used to make/break electrical circuits.

The electrical contact embodiments may be adapted for residential applications, industrial applications or other applications. For example, residential circuit breaker applications can have a current range from 10 A to 250 A with a rating voltage range from 120V to 240V. Industrial circuit breakers can have a current range from 15 A up to 6000 A with a voltage rating from 240V up to 1000V. It is possible the electrical contacts may be adapted for electrical interconnection devices such as a circuit breaker for: (1) low voltage circuit breakers with less than 600 volts; (2) medium voltage circuit breakers with greater than 2.4 kv to less than 69 kv; (3) extra high voltage circuit breakers that are greater than 34 kV.

When a pair of electrical contacts is under voltage open, current may continue to flow from one electrical contact to the other, ionizing the gas through which it passes. This column of ionized gas, usually called an "electric arc," has a maximum length that depends on various parameters such as the nature and the pressure of the gas, the voltage across the terminals, the contact material, the geometry of the equipment, the impedance of the circuit, etc.

It is contemplated that the electrical contact may be used in an interconnection device like a circuit breaker that employs a pair of mating contacts which establish a current path there between during normal operation of the circuit into which the breaker is installed. Wherein one of the contacts is a movable contact (e.g. circuit breaker arm) connected to an end of an elongated rotatable blade, while the other contact can be a stationary contact attached to a fixed metallic support or conductor.

The amount of energy released by the electric arc is sufficient, in some instances, to melt the constituent material of the contacts, which not only results in degradation of the metallic parts but also may sometimes result in the electrical contacts being welded together, with the consequence of locking the equipment.

In AC applications, arc cut-off is facilitated by the applied current passing through zero. However, certain protection devices cut off very high currents, resulting in arcs of sufficient energy to damage the contacts.

Thus, it may be desirable that the material properties of electrical contacts meet several specifications for use in oxidizing atmospheres and/or where severe arcing is anticipated. Example specifications include low contact resistance in order to avoid excessive heating when the current is flowing, good resistance to welding in the presence of an electric arc, and/or low erosion under the effect of the arc. Other material property specifications for electrical contacts may include acceptable mechanical and/or electrical wear properties. Mechanical wear properties can include wear with no load current such as loss of material due to sliding friction, and/or mechanical wear with load current. Electrical wear properties can be wearing due to electrical arcing under repeated applied stress and effect of electrical current. Meeting these desired requirements has been elusive.

To provide suitable material properties, in one or more embodiments, an electrical contact device/apparatus is provided that includes a first element of a first material having one or more aperture, and a second element of a second material, the second element positioned within at least one aperture of the one or more aperture, wherein the second material is different from the first material. Specifically, the first element could be considered an outer region arranged to surround the second element (or inner region), such that the second element occupies a hole or aperture located in a center region of the first element. However, many different shapes and orientations of the first element of the first material in relation to the second element of the second material are contemplated. For example, the donut-like configuration described herein is only provided as one example.

Further, the shape of at least one aperture of the one or more apertures of the first element could be one of the same or a different shape from the first element. Specifically this means, it is possible the first element could have the same or a different shape than the second element. Further, the second element would have an approximate similar shape as the at least one aperture of the first element.

Further still, the shape of the first element and at least one aperture of the one or more apertures of the first element can be one of a geometric shape, a non-uniform shape or a uniform shape. Further, it is possible that the second element could have one of a geometric shape, a non-uniform shape, or a uniform shape, so that the second element shape corresponds to the at least one aperture of the one or more aperture of the first element.

According to embodiments, the first element of the first material may possess material properties having superior mechanical and electrical wear properties. For example, material properties such as a low coefficient of thermal expansion, a high melting point, and/or a high tensile strength may be provided. Other beneficial material properties may include a low vapor pressure property, and/or a high density property, as well as a suitable hardness under standard operating conditions. For example, the first material can have one or more physical properties from the group consisting of one of a thermal conductivity range of 109 to 419 W/m·° K, a temperature coefficient electrical resistance range of 0.0014 to 0.0041/° K or an electrical resistivity range of 1.7 to 5.5 μΩ·cm.

By non-limiting example, the first material may be a material having a composition of Tungsten (W) and silver (Ag). For example, in some embodiments the composition may include about 50% tungsten and about 50% silver. Tungsten possesses material properties including superior mechanical and electrical wear properties. For example, Tungsten's material properties include: a relatively low coefficient of thermal expansion; a relatively high melting point (3,422° C., 6,192° F.); and a relatively high tensile strength. Tungsten's other material properties include having a relatively low vapor pressure (at temperatures above 1,650° C., 3,000 F), a very high density (a density of 19.3 times that of water) as well as being a hard metal under standard operating conditions. However, other materials other than tungsten are contemplated such as nickel.

Silver has a relatively high electrical conductivity material property, along with other beneficial material properties. It is noted that during operation, the tungsten-silver composition maintains superior mechanical and electrical wear properties when hot. It is possible the first material may have a composition of any silver or copper alloy, e.g. silver refractory metals, copper refractory metals, silver metal oxides, etc.).

The second material may possess material properties including superior electrical conductivity properties. Other beneficial material properties may include having relatively high thermal conductivity properties and/or relatively low contact resistance properties. For example, the second material can have one or more physical properties from the group consisting of one of a thermal conductivity range of 140 to 370 W/m·° K, a temperature coefficient electrical resistance range of 0.0014 to 0.0036/° K or an electrical resistivity range of 2.0 to 5.0 μΩ·cm.

By non-limiting example, the second material may have a composition including Silver (Ag) with graphite (C) material. Possible compositions of the second material may include a range of one of 70% to 98% silver, 85% to 98% silver or 92% to 98% silver, wherein another material may be included in the composition such as graphite. For example, one suitable composition may include 95% or more silver with at least a portion of graphite (or some other material having similar graphite properties). It is noted such mixtures provide relatively low resistivity material properties during operation. Further, the composition, when hot, typically becomes soft, wherein the first material, i.e., Tungsten-Silver composition, may provide support for the second material during operation. All percentages (%) herein are weight percentages.

Other types of materials considered for the second element can include any type of silver refractory contact materials including 60% Ag-40% W, three phase refractory contact 70% Ag-27% WC-3% C; Silver metal oxide contact materials in example AgCd10 (80% Ag-10% Cd), $AgSnO_2$ 8 along other Silver metal oxide contacts. Further, it is possible other types of materials considered for the second material may include any silver or copper alloy, e.g. silver refractory metals, copper refractory metals, silver metal oxides, etc.).

In determining material compositions for the first element and the second element, at least one relevant consideration may include capillary action during melting of two or more materials during arcing, which may provide a wetting activity that maintains lower resistivity on the contact surface. For example, as noted above the first element may have a tungsten-silver composition, which tends to get hot during operation, it still provides superior mechanical and electrical wear properties. At least one benefit provided by the tungsten-silver composition is that it ensures suitable structure for supporting the silver-graphite second material, since the silver-graphite composition tends to get soft when hot during operation.

In some embodiments, the blending of materials as disclosed above may provide blended material properties that may not be provided from a single material. Additionally, in some embodiments, matching (or possibly fusion of) different material types can create a device that addresses unique performance properties such as superior mechanical and/or electrical wear properties or conductivity properties during operation. Specifically, using different material compositions for the first element and the second element can together provide desired performance attributes when used in arcing electrical applications (opening/closing) of an electrical circuit. Further, it is intended that the composition of the first element with that of the composition of the second element will perform differently under such conditions. It is noted that the electrical contacts may wear to a degree, but not to the point of not being able to provide electrical contact operation.

FIG. 1 illustrates a top view of the electrical contact device 100, in accordance an embodiment. The electrical contact device 100 can include a donut-like configuration. For example, the donut-like configuration may include a first element (or outer region) 102 of a first material surrounding a second element (or inner region) 104 of a second material, wherein the second element 104 of the second material occupies an aperture portion (or an annulus portion) of the donut-like configuration. In some embodiments, as with residential circuit breaker contacts, the electrical contact could have a diameter of about 2.159 mm with a thickness of about 1.016 mm, or it is possible to have a length of 15.875, a width of 7.938 mm and a height of 4.763 mm. However, other dimensions are contemplated which can depend on the specific intended electrical contact application.

Figure 2:
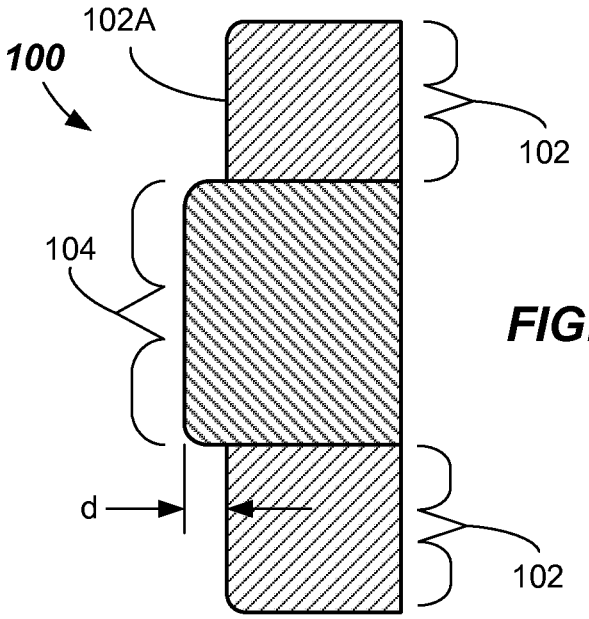
FIG. 2 is a cross-sectioned side view of the electrical contact device showing the second element extending outwardly from a plane of the first element, according to embodiments.

FIG. 2 is a cross-sectioned side view of the electrical contact device 100 showing the second element 104 of the second material extending outwardly from a top surface 102A of the first element 102 of the first material (see cross-section no. 2 in FIG. 2). In this particular embodiment, the second element 104 extends above the plane of the top surface 102A of first element 102. In some embodiments, the second element 104 may extend above the top surface of the first element 102 by a distance "d" of between about 0.05 mm to about 0.38 mm, about 0.13 mm to about 0.25 mm or 0.03 mm to about 0.50 mm. Other extension distances may be employed.

Figure 4A:
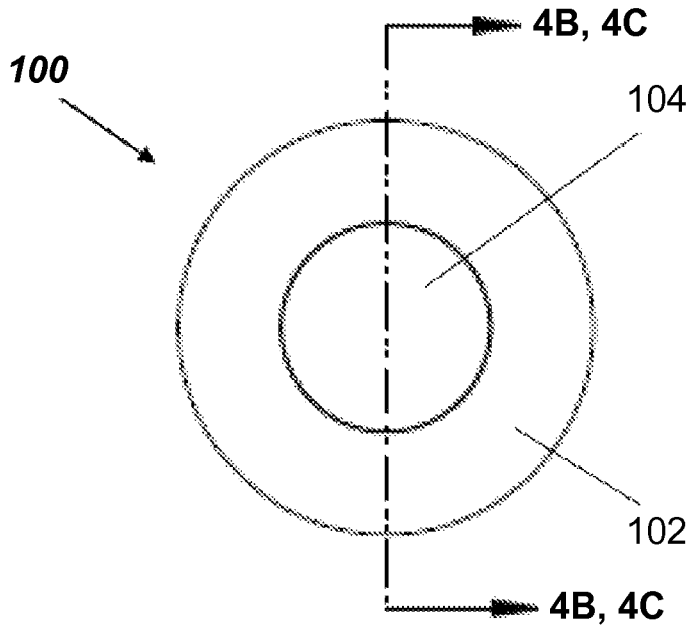
FIG. 4A illustrates a front plan view of the electrical contact device, according to embodiments.
Figure 4B:
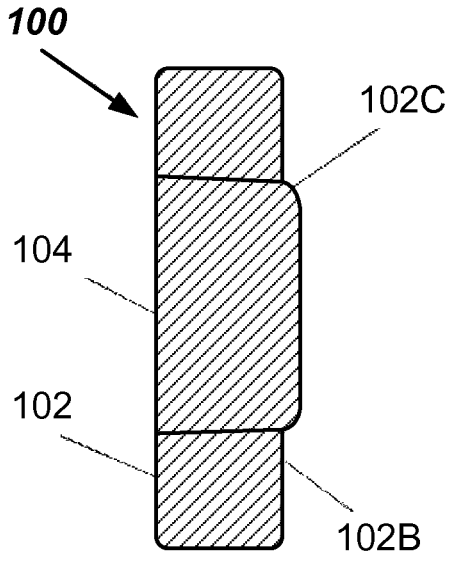
FIG. 4B illustrates a cross-sectional view of FIG. 4A with the second element extending outward from a top plane of the first element of the electrical contact device, according to embodiments.
Figure 4C:
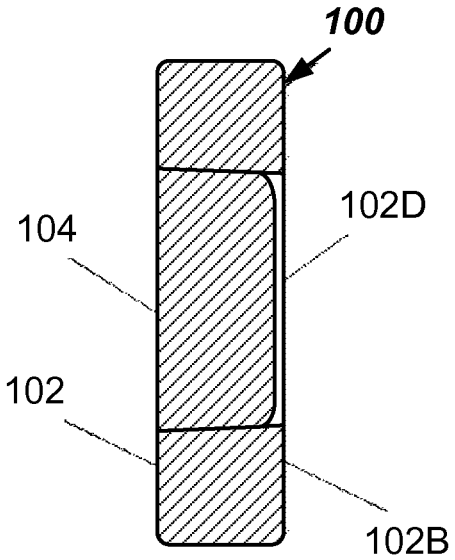
FIG. 4C illustrates a cross-sectional view of FIG. 4A with the second element not extending outward from a top plane of the first element of the electrical contact device so as to form a recess or cavity, according to embodiments.

Still referring to FIG. 2, other configurations are possible such as only a portion of the second element 104 may extend above the plane of the first element 102 or that the second element 104 does not extend above the plane 102A of the first element 102 (see FIG. 4A-C).

Figure 3A:
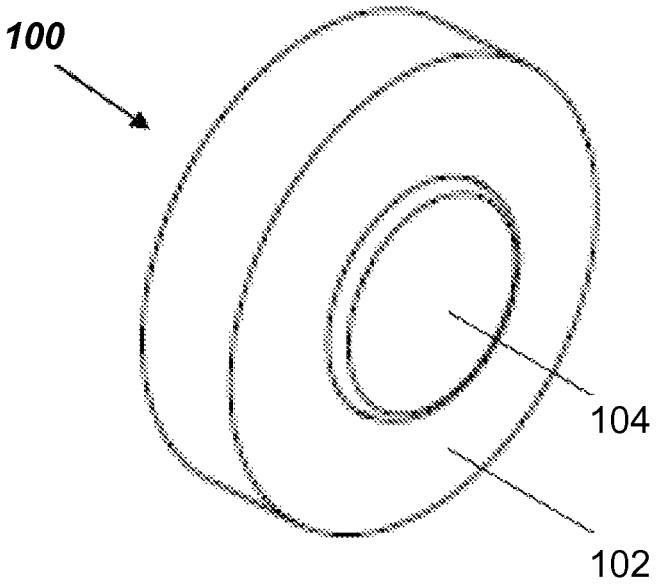
FIG. 3A illustrates a perspective view of the electrical contact device, according to embodiments.
Figure 3B:
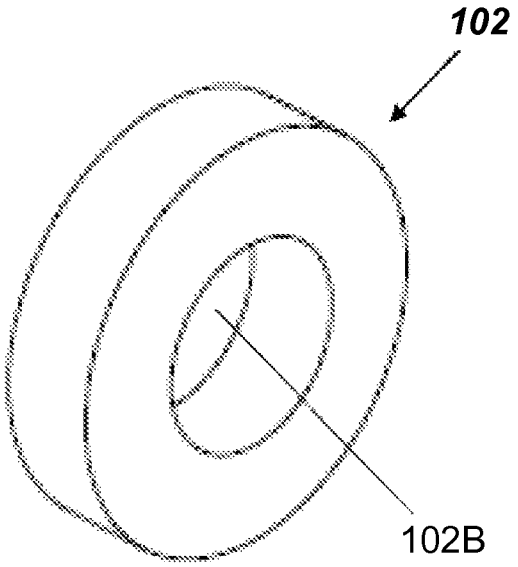
FIG. 3B illustrates a perspective view of the first element of the electrical contact device, according to embodiments.
Figure 3C:
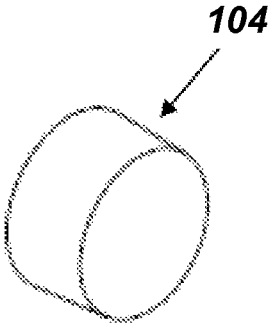
FIG. 3C illustrates a perspective view of the second element of the electrical contact device, according to embodiments.

FIGS. 3A-3C, FIG. 3A illustrates a perspective view of the electrical contact device 100, showing the first element 102 of the first material and the second element 104 of the second material. FIG. 3B shows a perspective view of the first element 102 of the first material and the at least one aperture 102B of the first element. It is possible that the first element could have more than one aperture 102B. FIG. 3C shows a perspective view of the second element 104 of the second material. As noted above, it is possible the first element 102 and the at least one aperture 102B of the one or more aperture have a shape that is one of the same or different, such that both have a shape from the group consisting of a geometric shape, a non-uniform shape or a uniform shape.

Still referring to FIGS. 3A-3C, the second element 104 and the at least one aperture 102B of the one or more aperture can have a shape that is approximately the same, such that both have a shape from the group consisting of a geometric shape, a non-uniform shape or a uniform shape.

FIGS. 4A-4C, FIG. 4A illustrates a top view of the electrical contact device 100, showing the first element 102 of the first material and the second element 104 of second material. FIG. 4B is a cross-sectional view along line A of FIG. 4A that illustrates the second element 404 extending outward from the top surface 102B of the first element 102 as an extending portion 102C. FIG. 4C illustrates the second element 104 not extending outward from the top surface 102B of the first element 102, so as to create a recess or cavity portion 102D. For example, it is possible the second element recess or cavity 102D have a depth measured from the top plane of the first element of one of about 0.05 mm to about 0.25 mm, 0.03 mm to about 0.30 mm or about 0.04 mm to about 0.5 mm.

Figure 5:
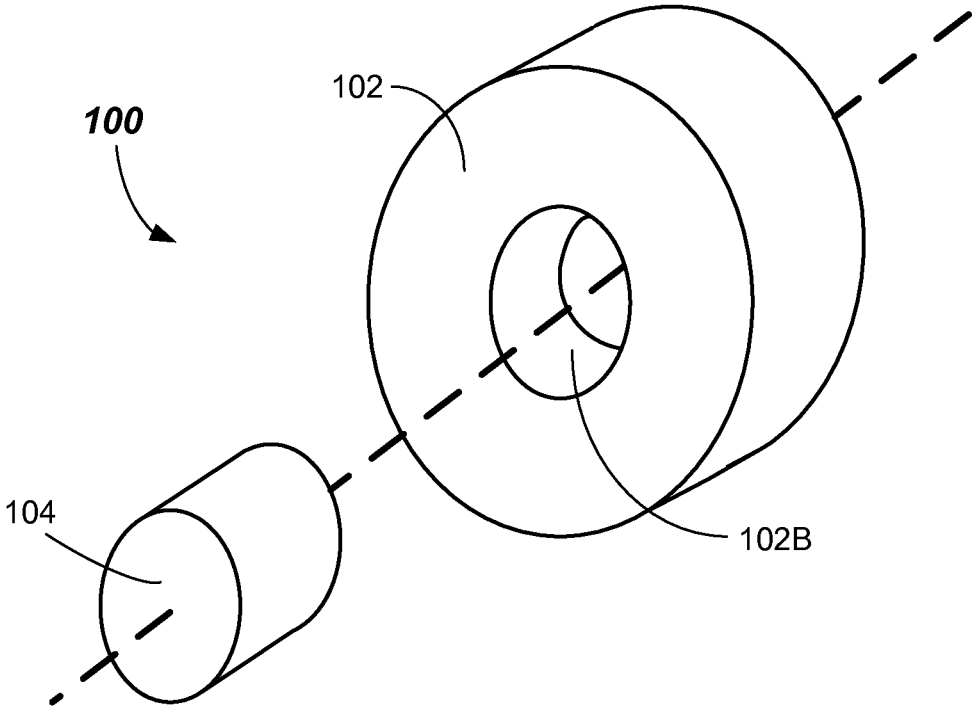
FIG. 5 illustrates an exploded perspective view of the electrical contact device, showing the second element of a second material that is to be inserted in an opening, i.e., center region, of the first element of first material, according to embodiments.

FIG. 5 illustrates an exploded perspective view of the electrical contact device 100, showing the second element 104 that is to be inserted in the opening 102B of the first element 102. The second element 104 may possess material properties including superior electrical conductivity properties. There are many different types of materials that could be used for the composition of the second material. As noted above, the second element 104 of the second material can be a composition of Silver (Ag) with a portion of another material, such as graphite material. As noted above, silver possesses the highest electrical conductivity of any element, the highest thermal conductivity of any metal and the lowest contact resistance of any metal. For example, the second material may comprise substantially of silver having a range of one of 70% to 98% silver, 80% to 98% silver or 90% to 98% or more silver. Other materials are contemplated for the second composition that may include any silver or copper alloy, e.g. silver refractory metals, copper refractory metal, silver metal oxides, etc.

Figure 6A:
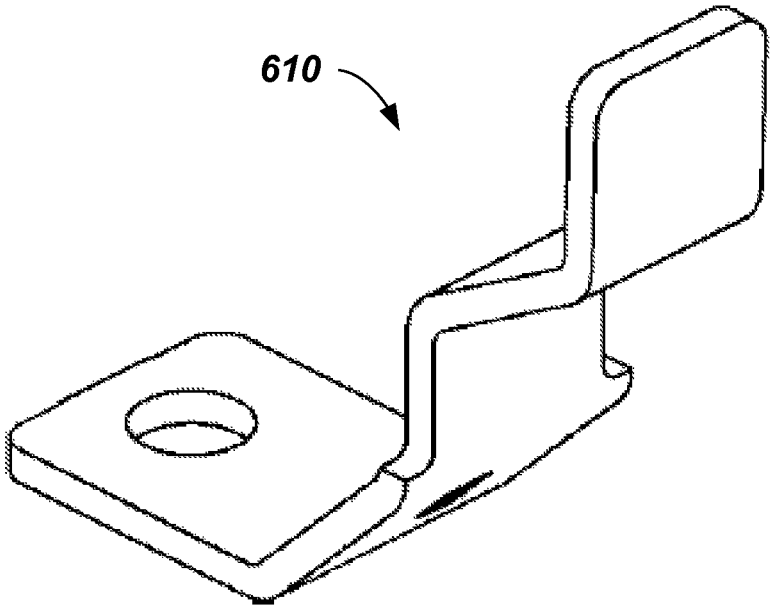
FIG. 6A illustrates first structure or conductor that may be used for supporting the electrical contact device, according to embodiments.
Figure 6B:
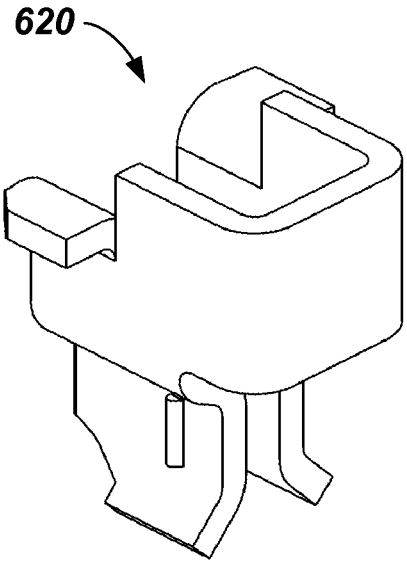
FIG. 6B shows a second metallic structure or conductor that may be used for supporting the electrical contact device, according to embodiments.

FIG. 6A illustrates the first metallic structure or conductor 610 that may be used for supporting the electrical contact device, according to embodiments. It is contemplated the shape of the metallic support or conductor can be of any type of shape, such that the first metallic structure 610 illustrated is only one example of many shapes considered.

Still referring to FIG. 6A, the electrical contact device may be attached to the metallic structure or conductor 610 by any suitable attaching means, such as a mechanical type of attaching means, i.e., rivet, or some other type of attaching means such as soldering can be used. One type of solder may be used such as a solder containing silver and B-copper 5 ($BCu_5$) along with a wetting agent. Other methods of securing and/or coupling the first element and second element are contemplated. Further, the metallic support or conductor may or may not extent over the first element which will likely depend upon the design of the metallic support or conductor.

Still referring to FIG. 6A, the metallic support or conductor 610 may be part of a current path of any electrical interconnection devices. For example, the metallic support or conductor may be an integral part of a spring loaded circuit breaker arm and/or some other element within a circuit interconnect device or circuit breaker. It is contemplated the electrical contact can be adapted to be included in stationary contact applications, moveable contact applications as well as secondary moveable contact applications.

Figure 6C:
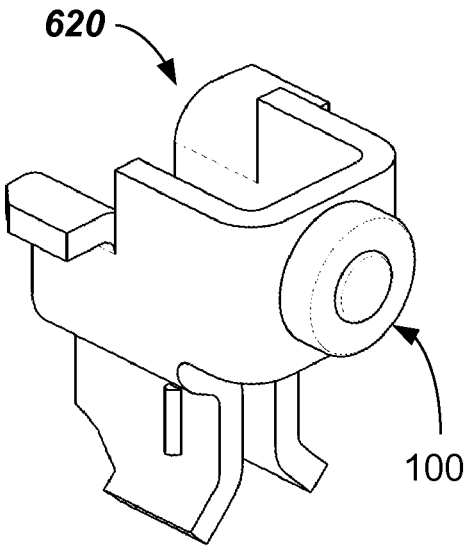
FIG. 6C shows the electrical contact device attached to the second metallic structure or conductor, according to embodiments.
Figure 6D:
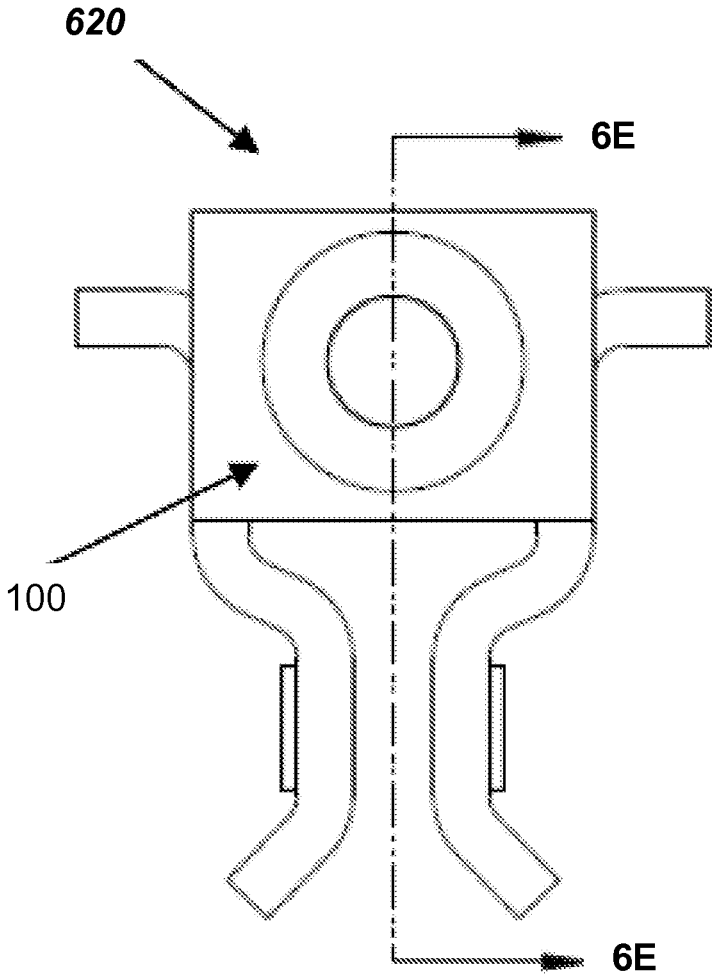
FIG. 6D shows a front view of the second metallic structure or conductor with the electrical contact device attached, according to embodiments.
Figure 6E:
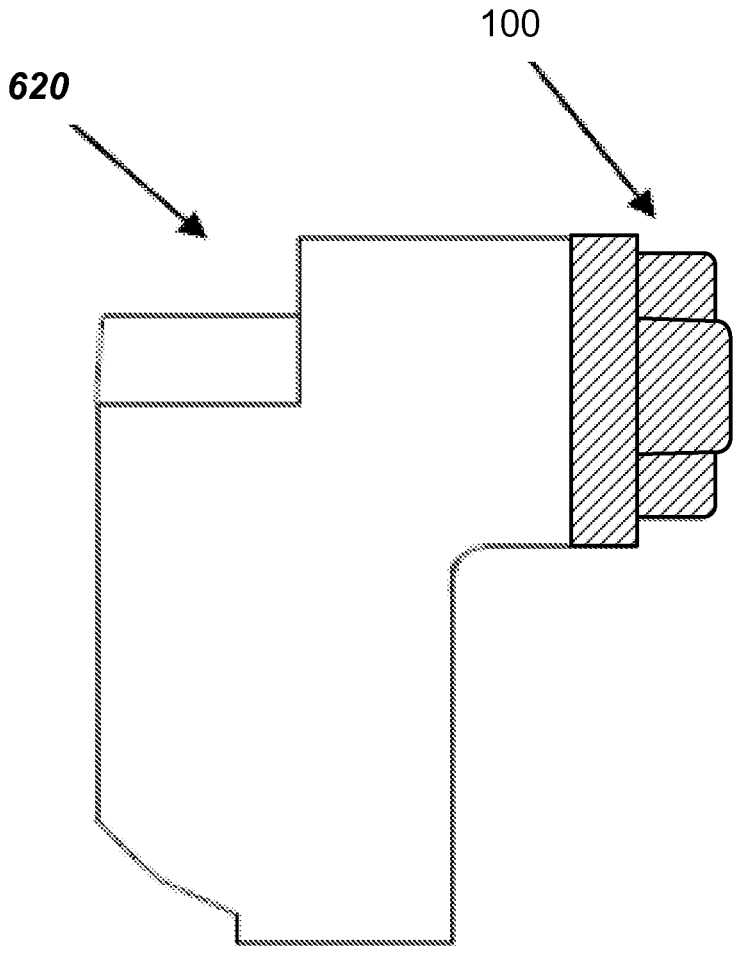
FIG. 6E shows a cross sectional view of the second metallic structure or conductor with the electrical contact device attached, according to embodiments.

FIGS. 6B-6E, FIG. 6B shows a second metallic structure or conductor 620 that may be used for supporting the electrical contact device without the electrical contact attached. FIG. 6C shows the second metallic support or conductor 620 with the electrical contact device 100 attached. FIG. 6D shows a front view of the second metallic structure or conductor 620 with the electrical contact device 100 attached. FIG. 6E shows a cross sectional view along line A of FIG. 6D of the second metallic structure or conductor 620 with the electrical contact device 100 attached. As noted above, the electrical contact device 100 may be attached by several attaching means including mechanical types of attaching as well as other attaching means such as by soldering.

Referring to FIGS. 6C-6E, it is possible the overall dimension of the metallic support or conductor where the electrical contact is attached can be for example from one of about 14.48 mm (or 0.570 inches) width, about 16.27 mm (or 0.640 inches) height and about 12.09 mm (or 0.476 inches) length; about 12.70 mm (or 0.500 inches) width, about 29.870 mm (or 1.176 inch) height and 32.46 mm (or 1.278 inches) length). It is possible the electrical contact can have other dimensions such as about 9.00 mm width, about 40.00 mm height and about 40 mm length.

Figure 6F:
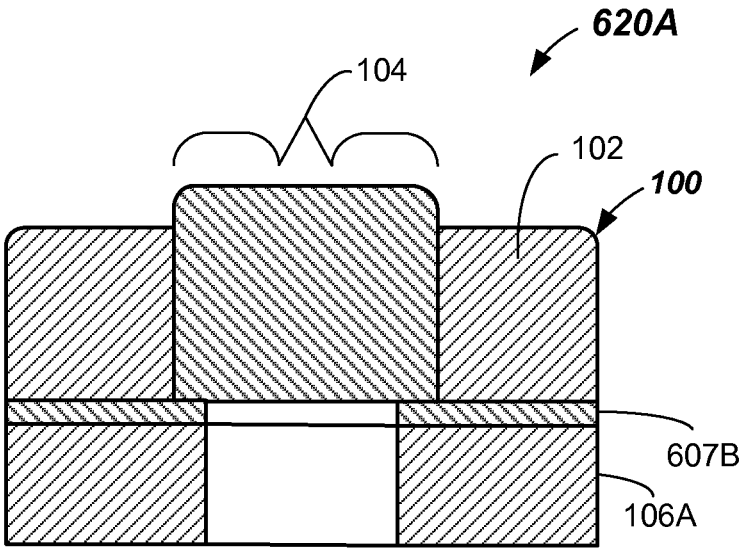
FIG. 6F illustrates a cross-sectioned side view of an electrical contact assembly adapted for use in a circuit interconnect device, according to embodiments.

FIG. 6F illustrates a cross-sectioned side view of an electrical contact assembly 620A adapted for use in a circuit interconnect device. The electrical contact assembly 620A includes an electrical contact device 100 as described herein having a first element 102 of a first material and a second element 104 of a second material different from the first material. The first element 102 and the second element 104 can be soldered onto a metallic support 106A by a solder layer 607B, as depicted. As mentioned, other methods of securing and/or coupling the first element 102 and/or second element 104 may be employed.

Figure 6G:
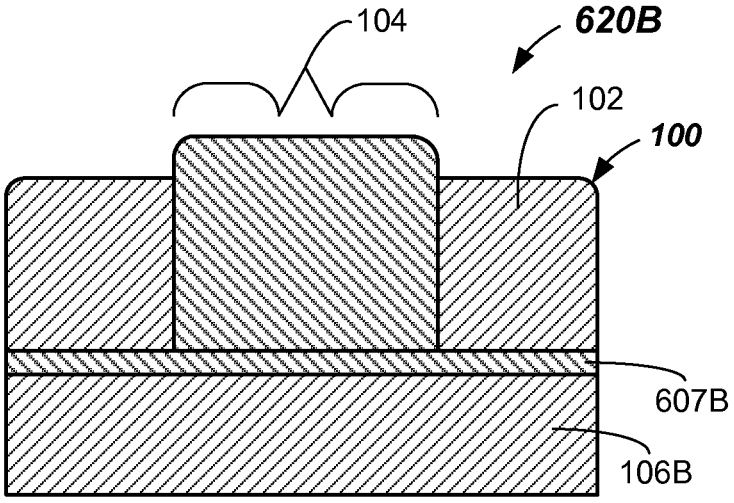
FIG. 6G illustrates an alternative electrical contact device, with the first element and the second element soldered to a support structure by a solder layer, according to embodiments.

FIG. 6G illustrates an alternative electrical contact device 620B, with the first element 102 and the second element 104 soldered to a support structure 106B by a solder layer 607B.

Still referring to FIGS. 6A-6G, in each embodiment, the support structure 106A may be an electrically conductive material and may be secured to or mounted on another support structure or otherwise integral therewith.

Figure 7:
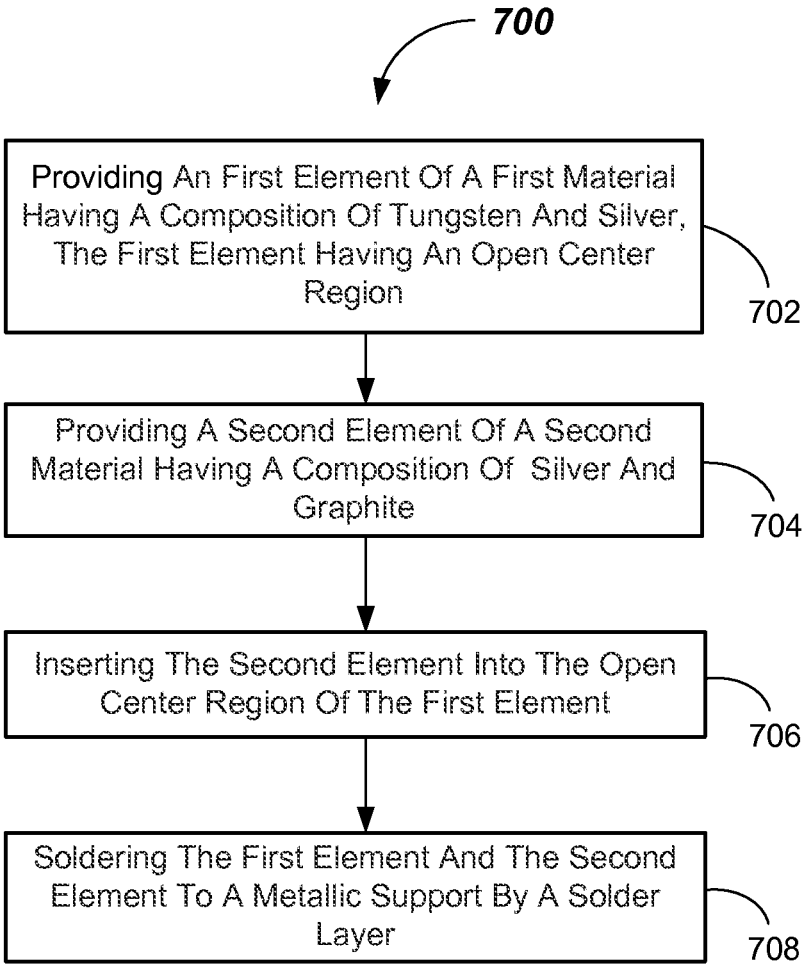
FIG. 7 illustrates a flowchart of a method of manufacture according to embodiments.

FIG. 7 is a flowchart illustrating a method 700 for preparation of an electrical contact according to embodiments. The method 700 includes, in 702, providing the step of a first element of a first material having a composition of tungsten and silver, the first element having one or more apertures, i.e., an open center region. In step 704, providing the second element of a second material having a composition of silver and graphite. In step 706, inserting the second element into at least one aperture of the one or more aperture of the first element, i.e., into the open center region of the first element. In step 708, soldering the first element and the second element to at least one metallic support (or conductor) by a solder layer.

Still referring to FIG. 7, the method can include the first element of a first material including silver in powder form that can be mixed with tungsten particles (or some other similar like material), the silver-tungsten mixture can be poured into a dye and pressed, after pressing, heat can be applied via an oven, wherein a disk-like part can be formed having at least opening, i.e., wherein the second element can be later inserted therein.

Still referring to FIG. 7, the method can include the second element of a second material including assembling 95% or more silver and 5% or less graphite (for example). The silver-graphite material can be heated and then poured into a similar dimension structure approximate in size to the opening of the first material and then press fitted into the opening of the first material. It is also possible; the silver-graphite material can be heated to form a part, wherein the part is cut to form the opening of the first material and then press fitted into the opening.

While the disclosed subject matter is susceptible to various modifications and alternative forms, specific embodiments and methods thereof have been shown by way of example in the drawings and are described in detail herein. It should be understood, however, that it is not intended to limit the disclosed subject matter to the particular apparatus, systems or methods disclosed, but, to the contrary, the intention is to cover all modifications, equivalents and alternatives falling within the scope of the disclosed subject matter.

What is claimed is:

1. An electrical contact assembly, comprising:

an outer element of a first material composition having one or more apertures, wherein the first material composition includes an electrically conductive metal having a first range of % of the electrically conductive metal and a first material, the first material composition having a mechanical wear property and an electrical wear property;

an inner element of a second material composition contacted through a length of at least one aperture of the one or more aperture, wherein the second material composition includes the electrically conductive metal having a second range of % of the electrically conductive metal and a second material, the second material composition having an electrical conductivity property; and a solder layer configured to solder both the inner element and the outer element directly to at least one conductor such that both the inner element and the outer element are soldered onto the at least one conductor by the solder layer, wherein the outer element is arranged to surround the inner element such that the outer element provides a structure for supporting the inner element when the inner element gets soft when hot during operation, wherein the second range of % of the electrically conductive metal is different from the first range of % of the electrically conductive metal, wherein the second material is different from the first material.

2. The electrical contact assembly of claim 1, wherein the electrically conductive metal in the first material composition comprises silver having a range of one of 30% to 60% silver, 40% to 60% silver, or 50% to 60% silver.

3. The electrical contact assembly of claim 2, wherein the first material includes a portion of tungsten.

4. The electrical contact assembly of claim 1, wherein the electrically conductive metal in the second material composition comprises silver having a range of one of 70% to 98% silver, 80% to 98% silver, or 90% to 98% silver.

5. The electrical contact assembly of claim 4, wherein the second material includes a portion of graphite.

6. The electrical contact assembly of claim 1, wherein the outer element and the at least one aperture of the one or more aperture have a shape that is one of the same or different, such that both have a shape from the group consisting of a geometric shape, a non-uniform shape or a uniform shape.

7. The electrical contact assembly of claim 1, wherein the inner element and the at least one aperture of the one or more aperture have a shape that is approximately the same, such that both have a shape from the group consisting of a geometric shape, a non-uniform shape or a uniform shape.

8. The electrical contact assembly of claim 1, wherein the inner element extends beyond a plane of a top surface of the outer element by one of about 0.05 mm to about 0.38 mm, about 0.13 mm to about 0.25 mm, or 0.03 mm to about 0.50 mm.

9. The electrical contact assembly of claim 1, wherein the inner element recess or cavity has a depth measured from the top plane of the outer element of one of about 0.05 mm to about 0.25 mm, 0.03 mm to about 0.30 mm, or about 0.04 mm to about 0.5 mm.

10. The electrical contact assembly of claim 1, further comprising at least one metallic support in communication with the outer element and the inner element, the at least one metallic support is part of a current path of at least one electrical interconnection device.

11. The electrical contact assembly of claim 1, wherein the first material composition has one or more physical properties from the group consisting of one of a thermal conductivity range of 109 W/m·° K to 419 W/m·° K, a temperature coefficient electrical resistance range of 0.0014/° K to 0.0041/° K, or an electrical resistivity range of 1.7 μΩ·cm to 5.5 μΩ·cm.

12. The electrical contact assembly of claim 1, wherein the second material composition has one or more physical properties from the group consisting of one of a thermal conductivity range of 140 W/m·° K to 370 W/m·° K, a temperature coefficient electrical resistance range of 0.0014/° K to 0.0036/° K or an electrical resistivity range of 2.0 μΩ·cm to 5.0 μΩ·cm.

13. The electrical contact assembly of claim 1, wherein the electrical contact is incorporated into a group consisting of at least one type of circuit interconnect device, at least one type of circuit breaker, at least one type of switch or at least one type of other non-circuit breaker devices.

14. An electrical contact assembly of a circuit interconnect device, comprising:

a first element of a first material, the first element having one or more aperture;

a second element of a second material, the second element positioned in at least one aperture of the one or more aperture, wherein the second material is different from the first material; and a solder layer configured to solder both the first element and the second element directly to at least one conductor such that both the first element and the second element are soldered onto the at least one conductor by the solder layer.

15. The electrical contact assembly of claim 14, wherein the first material includes silver having a range of one of 30% to 60% silver, 35% to 60% silver, or 45% to 60% silver.

16. The electrical contact assembly of claim 15, wherein the first material includes a portion of tungsten.

17. The electrical contact assembly of claim 14, wherein the second material includes a silver having a range of one of 70% to 98% silver and includes a portion of a graphite; 85% to 98% silver and includes a portion of at least one other material, or 92% to 98% or more silver and includes a portion of at least one other material.

18. A method for preparation of an electrical contact, comprising:

providing a first element of a first material having a composition of silver having a range of about 40% to about 60%, the first element having one or more aperture;

providing a second element of a second material having a composition of silver having a range of about 70% or more;

inserting the second element into at least one aperture of the one or more aperture of the first element; and soldering both the first element and the second element directly to at least one conductor by a solder layer such that both the first element and the second element are soldered onto the at least one conductor by the solder layer.

19. The method for preparation of the electrical contact of claim 18, wherein the first element comprises a powdered metal component including at least a portion of silver in powder form mixed with at least a portion of another material, the mixture is poured into a die and pressed, after pressing, heat is applied via an oven, wherein a disk-like part is formed having the at least one aperture.

20. The method for preparation of the electrical contact of claim 18, comprising:

heating and pouring the assembly of the second material into the at least one aperture of the one or more aperture of the first element; or press fitting the assembly of the second element into the at least one aperture of the one or more aperture of the first element.

* * * * *